United States Patent [19]

Böcker et al.

[11] Patent Number: 4,714,024

[45] Date of Patent: Dec. 22, 1987

[54] NOSE FOR AN INERTIAL PROJECTILE

[75] Inventors: Jürgen Böcker, Oberhausen; Klaus W. Klein, Neuss; Klaus Gersbach, Willich, all of Fed. Rep. of Germany; Jean-Claude Sauvestre, Saint-Doulchard; Patrick Montier, Bourges, both of France

[73] Assignees: Rheinmetall GmbH, Duesseldorf, Fed. Rep. of Germany; L'Etat Francais represente par le Delegue Ministeriel pour l'Armement, Paris, France

[21] Appl. No.: 874,048

[22] Filed: Jun. 13, 1986

Related U.S. Application Data

[63] Continuation-in-part of Ser. No. 603,133, Apr. 23, 1984, abandoned.

[30] Foreign Application Priority Data

Apr. 23, 1983 [DE] Fed. Rep. of Germany ..... 3314751

[51] Int. Cl.[4] ..... F42B 13/16

[52] U.S. Cl. ..... 102/521

[58] Field of Search ..... 102/520–523, 102/513

[56] References Cited

U.S. PATENT DOCUMENTS 3,148,472 9/1964 Hegge et al. ..... 102/521

3,750,585 8/1973 Feldman ..... 102/513

3,902,424 9/1975 Dietsch et al. ..... 12/513

FOREIGN PATENT DOCUMENTS 3047517 7/1982 Fed. Rep. of Germany ..... 102/521

*Primary Examiner*—Harold J. Tudor

[57] ABSTRACT

An improved nose construction for a subcaliber inertial projectile which is fired with the aid of a sabot. A hood or body is mounted on the nose portion of the projectile. The hood is made of synthetic material and includes longitudinally extending fracture zones and is of substantially cylindrical shape. The frontal portion of the hood is recessed and forms an air flow receiving surface. In lieu of a hood a body, made of a thermoplastic material or the like, may be mounted on the nose portion. This body is adapted to disintegrate as result of air friction. The presence of the hood or body on the nose portion of the projectile, as it exits from a non-illustrated gun barrel, avoids or at least reduces unfavorable air-streaming forces which destabilize the flight characteristics of the projectile and thereby favors a uniform separation of the sabot segments from the projectile. Such uniform separation reduces or completely eliminates undesirable oscillations during flight of the projectile. After the hood or body have disintegrated the projectile acquires a more favorable $c_w$ value (drag coefficient during flight.

2 Claims, 4 Drawing Figures

NOSE FOR AN INERTIAL PROJECTILE

CROSS-REFERENCE TO RELATED APPLICATION

This is a continuation-in-part application of the co-pending and co-assigned application Ser. No. 603,133, filed on Apr. 23, 1984 now abandoned.

BACKGROUND OF THE INVENTION

The fin-stabilized subcaliber projectiles of the state of the art generally include a sabot (drive cage) which defines in the frontal region of the projectile an air-trapping pocket which surrounds the frontal region and causes a separation of the sabot from the projectile upon the latter exiting from the muzzle of a gun barrel. This separation occurs as a result of the air resistance acting on the sabot at the air-trapping pocket (see for example U.S. Pat. No. 3,620,167 which is co-assigned to the assignee of the instant application). It has been observed that in the aforedescribed subcaliber projectile the separation of the sabot from the projectile is not uniform. This frequently leads to damaging oscillations of the inertial projectile. Oscillations during the flight of an inertial projectile may negatively influence the target impact accuracy and penetration capability of the projectile. This drawback is particularly pronounced with respect the more modern armored targets which require for their penetration and/or destruction particularly long inertial projectiles which must be as free as possible of oscillations during flight. Test firings to examine the behavior of inertial-projectile-sabot-arrangements have revealed that, in the region of the frontal region of the inertial projectile, there may occur unstable streaming conditions which inhibit the uniform separation of the sabot segments from the projectile.

SUMMARY OF THE INVENTION

It is a general object of this invention to provide a nose portion for an inertial projectile of the aforedescribed type in which the aforedescribed drawbacks are eliminated or at least ameliorated.

BRIEF DESCRIPTION OF THE DRAWINGS

This and other objects will become more readily apparent from the following detailed description of the present invention, reference being made to the accompanying drawing, in which.

DETAILED DESCRIPTION

Figure 1:
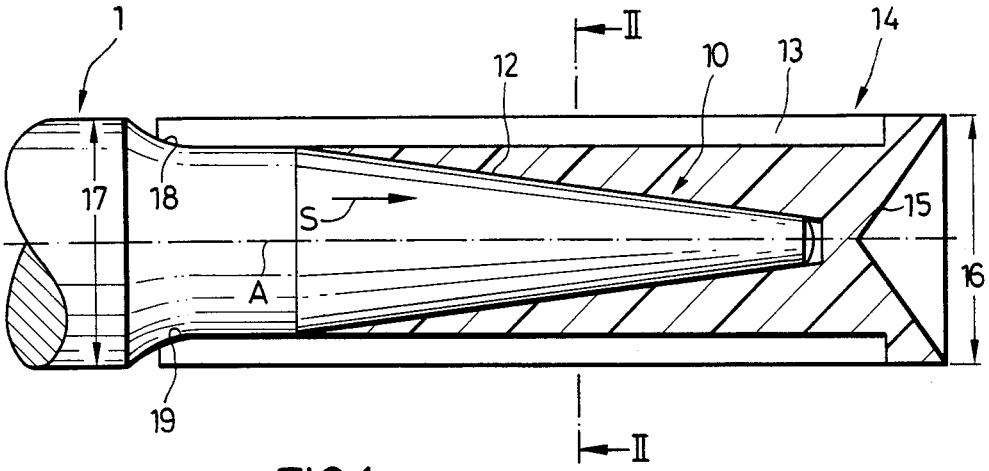
FIG. 1 is a side elevational view of a first embodiment of a nose portion of an inertial projectile in accordance with the invention, which is shown partially in longitudinal axial cross-section.
Figure 2:
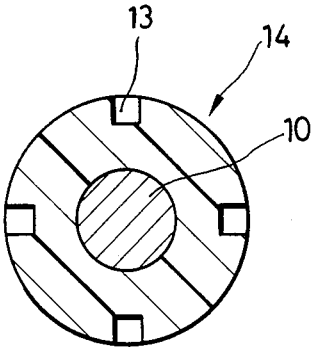
FIG. 2 is a cross-sectional view along line II—II of FIG. 1.

In the first embodiment of the invention illustrated in FIGS. 1 and 2 there is partially illustrated an inertial projectile 1 having a nose portion 10 defined by a frusto-conical generatrix 12. There is mounted on the nose portion 10 of the projectile a hood 14 of synthetic material and of substantially cylindrical shape. The hood has a plurality of uniformly spaced longitudinally extending recesses 13 and a recessed frontal airflow receiving surface 15. The hood 14 is slid over the nose portion 10 and secured thereon, for example by glueing. The hood 14 has a rear bearing surface 19, preferably configured frusto-conically, which abuts against a counter-surface 18 of the nose portion 10. The hood 14 has an external diameter 16 which dimensionally approximates the maximum external diameter 17 of the inertial projectile 1.

Figure 3:
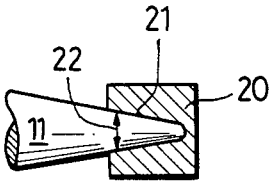
FIG. 3 is a side elevational view of a second embodiment of a nose portion of an inertial projectile in accordance with this invention, which is also shown partially in longitudinal axial cross-section.
Figure 4:
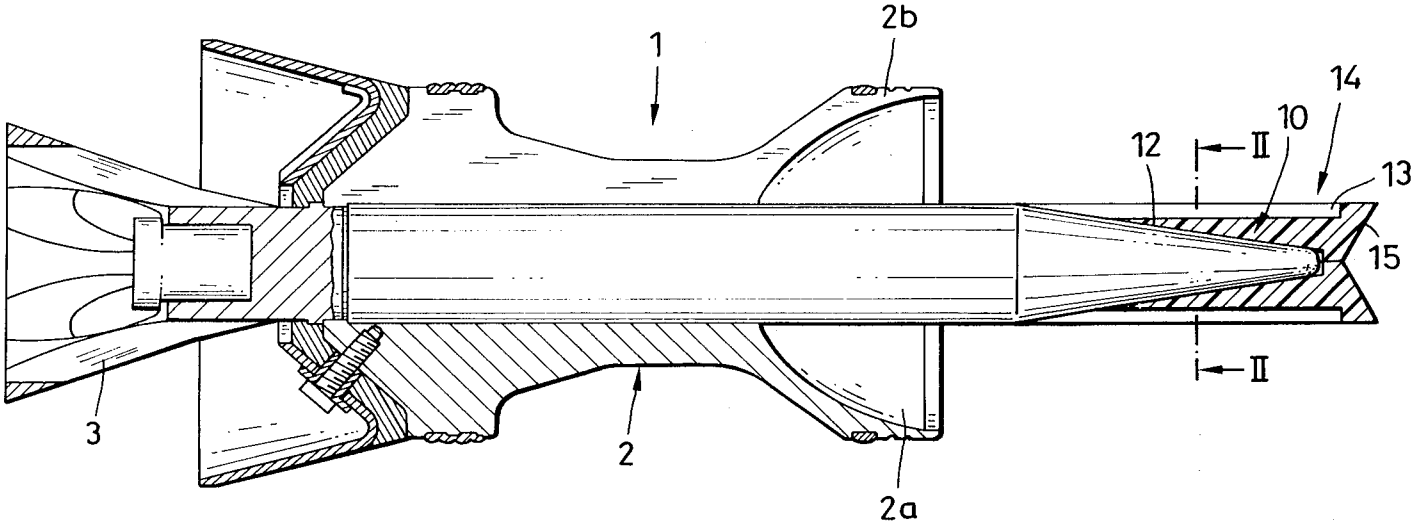
FIG. 4 is a side-elevational view partially in cross-section of a complete subcaliber sabot projectile having a large length to diameter (about 5 to 6) ratio.

In the embodiment of FIG. 3 the projectile 1 is not illustrated and only the frontal region of the nose portion 11 is illustrated. A body 20 is secured to the nose portion 11, for example, by glueing. By means of this body 20 the diameter 22 of the point region 21 of the nose portion 11 is dimensionally enlarged by a predetermined amount. The body 20 is made of a material which, due to the friction caused by air-streaming, which occurs during flight and after the projectile has exited from the gun barrel, is consumed by one or more of the following: melting, softening and combustion. The following types of material have been found suitable: thermoplastic material, or a magnesium alloy of the following composition:

| Chemical composition % | | | | | |
|---|---|---|---|---|---|
| Bi | Cd | Pb | Sn | Melting Point | Commercial Names |
| 50 | 10 | 27 | 13 | 70 | Woodmetal |
| 50 | | 25 | 25 | 94 | Rose's metal |

The inertial projectile 1 (intended however for training purposes) with a large length to diameter ratio is armed with a sabot 2 consisting of three segments *2a, 2b* and *2c*. According to the invention the nose portion, in the form of a synthetic hood 14 assures that the sabot 2 separates itself in an undisturbed manner from the projectile 1 through the pressure fluctuation of the oncoming flow of air.

When an inertial-projectile-sabot-arrangement, having a hood 14 or body 20 mounted on its nose portion 10 or 11, leaves the gun barrel in the direction of the arrow S, the corresponding hood 14 or body 20 prevents, in view of its diameter, that pressure oscillations caused by air resistance unduly disturb the separation of the sabot segments. An undesirable $c_w$-value (drag coefficient) in the point region must be taken into consideration (for a definition of the $c_w$-value see page 144 and following of Rheinmetall Handbook on Weaponry, Second Edition, published by Broenners Druckerei Breidenstein GmbH., Frankfurt a.M., West Germany). After the undisturbed separation of the sabot segments from the projectile 1, the dynamic air pressure acting on air-flow receiving surface 15 causes the hood 14 to break up along the recesses (fracture zones) 13. The several parts of the hood 14 made of synthetic material then separate from the nose portion 10 and a favorable $c_w$ (drag coefficient) is then present.

When the body 20 is used the more favorable $c_w$ (drag coefficient) is formed after the material of which the body 20 is made up has been consumed.

Thus while the improvement in the construction of the subcaliber inertial projectile is simple the advantages obtained thereby are significant while the manufacturing cost is quite low.

The subcaliber projectiles which are to be used with the above described sabots have a length to diameter ratio ranging from 1/10 to 1/30.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In an inertial projectile having a large length to diameter ratio with a segmented sabot surrounding the projectile body, whose segments are held to the projectile body by force locking bonding agents during passage through a gun barrel showing a frontal synclinal recess, which after the projectile has left the gun barrel causes a breaking up and separation of the segments from a front end due to high pressure within the recess from an oncoming airstream, the improvement comprising, a conical projectile nose protruding over a front edge of the sabot;

a cylindrical projectile mantle enlarged hood which protects the sabot, during separation of the segments from the projectile body, from pressure fluctuations, and which increases the drag coefficient of the projectile;

said nose corresponding substantially with one of its frontal diameters to the diameter of the cylindrical projectile mantle enlarged hood;

said hood releasing itself from the projectile nose only after separation of the sabot from the projectile body, thereby decreasing the drag coefficient of the projectile.

2. The improved projectile as set forth in claim 1, wherein (a) the external diameter of said hood corresponds substantially to the maximum external diameter of said projectile;

(b) said hood having a frontal air-receiving surface and a plurality of longitudinally extending external recesses which act as fracture zones for the hood; and (c) said air-receiving surface is retracted in such a way that when said projectile leaves the gun barrel the air resistance encountered by the projectile causes a breaking up and separation of the hood from the nose, whereby the drag coefficient of the projectile is improved.

* * * * *